US008123540B2

(12) United States Patent
Galluccio et al.

(10) Patent No.: US 8,123,540 B2
(45) Date of Patent: Feb. 28, 2012

(54) LAMP SOCKET HAVING A ROTOR ASSEMBLY

(75) Inventors: Gregory Galluccio, Smithtown, NY (US); Anthony Tufano, N. Massapequa, NY (US); Francisco Schapira, Valley Stream, NY (US); Cesar Vasquez, Chihuahua (MX); Carlos Salazar, Chihuahua (MX)

(73) Assignee: Leviton Manufacturing Co., Inc., Melville, NY (US)

( * ) Notice: Subject to any disclaimer, the term of this patent is extended or adjusted under 35 U.S.C. 154(b) by 0 days.

(21) Appl. No.: 13/014,972

(22) Filed: Jan. 27, 2011

(65) Prior Publication Data

US 2011/0124221 A1 May 26, 2011

Related U.S. Application Data

(63) Continuation of application No. 12/243,509, filed on Oct. 1, 2008, now abandoned.

(51) Int. Cl.
*H01R 33/02* (2006.01)

(52) U.S. Cl. ..... 439/241

(58) Field of Classification Search ..... 439/242, 439/241, 231, 236, 567, 66, 248; 362/217.08, 362/225, 147, 220; 315/56, 57
See application file for complete search history.

(56) References Cited

U.S. PATENT DOCUMENTS 2,163,902 A 6/1939 Wertlzhelser
(Continued)

FOREIGN PATENT DOCUMENTS

DE 32 35 846 A1 4/1983
(Continued)

OTHER PUBLICATIONS

"A Century of Quality Wiring Devices for Original Equipment Manufactures", OEM 100$^{th}$ Anniversary Edition, Leviton Manufacturing Co., Inc. 2005.

(Continued)

*Primary Examiner* — Alexander Gilman
(74) *Attorney, Agent, or Firm* — Carter, DeLuca, Farrell & Schmidt, LLP

(57) ABSTRACT

A socket assembly includes a rotor assembly, a housing, and at least one electrical contact. The rotor assembly has an axis of rotation and defines a channel. The rotor assembly is adapted to receive at least one lamp pin within the channel from an edge of the rotor assembly. The housing is adapted to receive the rotor assembly such that the rotor assembly is rotatable along its axis of rotation therein. The housing defines a notch adapted to receive each of the at least one lamp pin when each of the axis of each of the at least one pin is about parallel to the axis of rotation. A least one electrical contact is disposed within the housing and an electrical contact of the at least one electrical contact is adapted for operative engagement with a lamp pin of the at least one lamp pin.

24 Claims, 13 Drawing Sheets

U.S. PATENT DOCUMENTS 2,247,117 A 6/1941 De Reamer
3,176,260 A * 3/1965 Pascucci ..... 439/553
3,297,977 A 1/1967 Smith
3,305,823 A * 2/1967 Knuppel et al. ..... 439/241
3,328,577 A * 6/1967 Vermeulen et al. ..... 439/240
3,384,858 A 5/1968 Johnson
3,397,376 A 8/1968 Gombar
3,401,242 A 9/1968 McLaughlin
3,524,053 A 8/1970 Johnson
3,568,132 A 3/1971 Johnson
3,631,376 A 12/1971 Halfaker
3,639,887 A 2/1972 Johnson et al.
3,651,445 A 3/1972 Francis
3,681,593 A 8/1972 Genovese et al.
3,681,594 A 8/1972 Johnson
3,685,003 A 8/1972 Watt
3,752,977 A 8/1973 Davis
3,771,106 A 11/1973 Matsumoto et al.
3,828,299 A 8/1974 Johnson et al.
3,836,814 A 9/1974 Rodriquez
3,851,295 A 11/1974 Geier
3,975,073 A 8/1976 McLaughlin
4,084,873 A 4/1978 Grate
4,101,956 A 7/1978 Crane
4,102,558 A 7/1978 Krachman
4,198,108 A 4/1980 Bassetto
4,198,109 A 4/1980 Ustin
4,280,169 A 7/1981 Allen
4,298,918 A 11/1981 Metcalf, II
4,306,758 A 12/1981 Johnson et al.
4,347,460 A 8/1982 Latassa et al.
4,414,489 A 11/1983 Young
4,495,443 A 1/1985 Cummings
4,542,947 A 9/1985 Flor et al.
4,565,415 A 1/1986 Feinberg
4,570,105 A 2/1986 Engel
4,617,519 A 10/1986 Rosenthal
4,623,823 A 11/1986 Engel
4,637,671 A 1/1987 Johnson et al.
4,643,503 A 2/1987 Johnson et al.
4,645,283 A 2/1987 MacDonald et al.
4,660,906 A 4/1987 Haraden
4,683,402 A 7/1987 Aubrey
4,688,874 A 8/1987 Bjorkman
4,723,200 A 2/1988 Troen
4,744,767 A 5/1988 Henrici et al.
4,746,840 A 5/1988 Lim
4,754,197 A 6/1988 Zwald
D297,322 S 8/1988 Johnson et al.
D297,529 S 9/1988 Johnson et al.
4,772,216 A 9/1988 Szymanek
4,804,343 A 2/1989 Reedy
4,863,394 A 9/1989 Henshaw, Jr.
D304,716 S 11/1989 Johnson et al.
4,936,789 A 6/1990 Ugalde
4,939,420 A 7/1990 Lim
5,006,970 A 4/1991 Mackiewicz
5,015,917 A 5/1991 Nigg
5,044,974 A 9/1991 Pelton et al.
5,122,074 A 6/1992 Maag et al.
5,135,407 A 8/1992 Berends
5,150,008 A 9/1992 Lee
5,169,331 A 12/1992 Caldwell et al.
5,189,339 A 2/1993 Peshak
5,202,607 A 4/1993 Broyer et al.
5,217,190 A * 6/1993 Reed et al. ..... 248/27.3
5,261,831 A 11/1993 Vendal et al.
5,282,755 A 2/1994 Ahlstone
5,320,547 A 6/1994 Mews et al.
5,320,548 A 6/1994 Schadhauser
5,390,096 A 2/1995 DeKleine et al.
5,422,487 A 6/1995 Sauska et al.
5,514,000 A * 5/1996 Krause et al. ..... 439/248
RE35,344 E * 10/1996 Fry et al. ..... 439/557
5,575,673 A * 11/1996 Dahlem et al. ..... 439/248
5,596,247 A 1/1997 Martich et al.
5,616,042 A 4/1997 Raby et al.
5,634,820 A 6/1997 Vakil
5,636,919 A 6/1997 Walker
5,653,527 A 8/1997 Muessli
5,688,139 A 11/1997 Gust et al.
5,727,869 A 3/1998 Crosby et al.
5,743,626 A 4/1998 Walker
5,746,615 A 5/1998 Ichikawa et al.
5,758,952 A 6/1998 Getselis et al.
5,759,054 A 6/1998 Spadafore
5,816,837 A 10/1998 Henrici et al.
5,855,487 A 1/1999 Kunishi
D406,814 S 3/1999 Henrici
5,931,691 A * 8/1999 Mews et al. ..... 439/419
5,971,564 A 10/1999 Wang
D417,653 S 12/1999 Henrici
6,027,230 A 2/2000 Huber et al.
6,039,597 A 3/2000 Getselis et al.
6,048,220 A 4/2000 Altman et al.
6,082,873 A 7/2000 Schmidt
6,124,673 A 9/2000 Bishop
6,159,029 A 12/2000 Burwell
6,290,522 B1 9/2001 Campolo et al.
6,340,310 B2 1/2002 Henrici et al.
6,364,679 B1 * 4/2002 Gerstberger ..... 439/241
6,486,406 B1 * 11/2002 Greco et al. ..... 174/138 R
6,561,828 B2 5/2003 Henrici et al.
6,565,230 B2 5/2003 Ashley
6,570,306 B2 5/2003 Henrici et al.
6,582,253 B1 6/2003 Lau
6,632,100 B1 10/2003 Richardson
6,641,419 B1 11/2003 Richardson
D491,890 S 6/2004 Henrici et al.
D493,425 S 7/2004 Henrici et al.
6,869,298 B2 3/2005 Latsis
6,884,103 B1 4/2005 Kovacs
7,090,390 B2 8/2006 Pazula
7,097,327 B1 8/2006 Barton
7,125,159 B2 10/2006 Hirsch et al.
7,153,151 B2 12/2006 Lingemann et al.
7,247,040 B2 7/2007 Lingemann et al.
D550,884 S 9/2007 Tufano et al.
7,291,029 B2 11/2007 Hale et al.
7,322,722 B2 1/2008 Hartmann et al.
D564,129 S 3/2008 Tufano et al.
7,338,302 B2 3/2008 Thiele et al.
7,339,790 B2 3/2008 Baker et al.
D577,854 S 9/2008 Tufano et al.
7,448,892 B2 11/2008 Dowdle et al.
7,568,930 B2 8/2009 Brand et al.
7,736,163 B2 6/2010 Vogt et al.
2003/0068913 A1 4/2003 Henrici et al.
2003/0100210 A1 5/2003 Lewis
2005/0026483 A1 2/2005 Latsis
2005/0104524 A1 5/2005 Bishop
2005/0148242 A1 7/2005 Latsis
2005/0202704 A1 9/2005 Lingemann et al.
2006/0170323 A1 8/2006 Hirsch et al.
2006/0273730 A1 12/2006 Chang
2007/0066112 A1 3/2007 Tufano et al.
2007/0077801 A1 4/2007 Lingemann et al.
2007/0117466 A1 5/2007 Thiele et al.
2007/0183160 A1 8/2007 Tufano et al.
2009/0130880 A1 5/2009 Vogt et al.
2010/0081339 A1 4/2010 Galluccio et al.
2010/0120279 A1 5/2010 Vogt et al.

FOREIGN PATENT DOCUMENTS

DE 42 08 479 A1 9/1993
DE 20 2006 015 753 U1 1/2007
EP 0621661 B1 3/1998
EP 0834967 4/1998
EP 1562269 A1 8/2005
JP 61-103887 6/1986
JP 62-104384 6/1987

OTHER PUBLICATIONS

Non-Final Office Action for U.S. Appl. No. 12/243,509 dated Mar. 22, 2010.

Non-Final Office Action for U.S. Appl. No. 12/243,509 dated Sep. 27, 2010.

* cited by examiner

LAMP SOCKET HAVING A ROTOR ASSEMBLY

CROSS-REFERENCE TO RELATED APPLICATION

This application claims priority to and is a continuation of co-pending U.S. patent application Ser. No. 12/243,509 filed on Oct. 1, 2008, the entire disclosure of which is hereby incorporated by reference.

BACKGROUND

1. Technical Field

The present disclosure relates to lamp sockets, and in particular, to a lamp socket adapted ensure a lamp is fully engaged prior to being energized.

2. Description of Related Art

Fluorescent lamps typically comprise a hermetically sealed structure or tube containing one or more gases with a small amount of mercury contained therein. The tube is typically coated with a phosphor-based power along the inside of the tube. Additionally, fluorescent lamps also generally contain two electrodes spaced apart and configured such that current flows through the gas and mercury in certain conditions. When sufficient electric charge is applied between the electrodes, electrons migrate through the gas away from one electrode and towards the other. As aggregate electric charge is displaced, some of the electrons collide with the vapor-phase mercury thus exciting electrons contained therein into higher energy states (sometimes incorrectly referred to as "orbital" states). Quickly thereafter, these excited vapor-phase mercury atoms (ionized mercury gas) quickly drop to a lower excitation state and release one or more photons equal to the energy loss resulting from the reduced excitation state of the gas-phase mercury atom. The photons released from the mercury gas are mostly in the ultraviolet region of the light spectrum, and consequentially, are invisible to the human eye and are not directly desirable for human lighting. However, these UV photons are absorbed by the phosphor-based coating. The absorption of the UV photons excites the phosphor atoms, which after rising to a higher energy state, quickly return to a lower energy state giving off light mostly in the visible spectrum.

These fluorescent lamps typically include at least one pin and commonly two pins electrically connected to an electrode. Each electrode is at the end of the hermetically sealed tube. In some configurations, current is injected between the two pins of the electrode to heat the electrodes thereby "boiling off" electrons from the metal surface sending them into the gas thus partially ionizing the gas. However, in some embodiments, this function is bypassed and the two pins are simply electrically connected together in the control circuitry, the lamp socket and/or in the lamp housing.

These fluorescent lamps have a life span and therefore need frequent replacing from time to time. Several fluorescent lamp designs have been standardized including their respective lamp sockets; for example, T5, T8 and T12 are standard fluorescent lamp designs. Lamp sockets are usually designed so that fluorescent lamps may be quickly installed and/or removed. Typically, the lamp sockets are installed by a technician that inserts the pins of the florescent lamp into a socket (usually from the side) and rotates the lamp to secure the lamp within the lamp fixture. These florescent lamps are usually electrically connected immediately upon insertion or after a very minimal amount of rotation. When a florescent lamp is inserted into a lamp socket and not fully rotated, the lampholder may not be fully seated which may be undesirable.

SUMMARY

The present disclosure relates to lamp sockets, and in particular, to a lamp socket adapted ensure a lamp is fully engaged prior to being energized.

In one embodiment of the present disclosure, a multi-pin socket assembly includes a rotor assembly, a housing, and at least one electrical contact. The rotor assembly has an axis of rotation and defines a channel having a length about perpendicular to the axis of rotation. The rotor assembly is adapted to receive at least one lamp pin within the channel from an edge of the rotor assembly. Each of the at least one lamp pin defines a longitudinal axis. Each of the axis of each of the at least lamp pin is about parallel to the axis of rotation when each of the at least one lamp pin is received from the edge of the rotor assembly to within the channel. the housing is adapted to receive the rotor assembly such that the rotor assembly is rotatable along its axis of rotation therein. The housing defines a notch adapted to receive each of the at least one lamp pin when each of the axis of each of the at least one pin is about parallel to the axis of rotation. The rotator assembly is rotatable to at least first and second positions and the channel of the rotor assembly aligns with the notch of the housing when in the first position such that each of the at least one lamp pin is received through the notch of the housing and into the channel of the rotor assembly. A least one electrical contact is disposed within the housing and an electrical contact of the at least one electrical contact is adapted for operative engagement with a lamp pin of the at least one lamp pin. The electrical contact is operatively disengaged from the lamp pin when the rotor assembly is in about the first position and operatively engages the lamp pin when the rotor assembly is rotated at least substantially to the second position.

In yet another embodiment of the present disclosure, a socket assembly includes a mounting structure and a lamp socket. The mounting structure has a plurality of snaps adapted to secure the mounting structure to a receiving portion of a surface. Each of the plurality of snaps includes an elongated length defining an axis and each of the plurality of snaps includes a flange disposed at an end thereof. Each flange of each of the plurality of snaps extends at a radial angle of the axis and at least two of the plurality of snaps have different radial angles of extending flanges. The lamp socket is adapted to receive a lamp. The lamp socket operatively connected to the mounting structure to operatively secure the lamp to the receiving portion of the surface.

In yet another embodiment of the present disclosure, a socket assembly includes a rotor assembly, a housing, and at least one electrical contact. The rotor assembly defines an axis about perpendicular to a surface of the rotor assembly. The rotor assembly further defines a channel having a length about perpendicular to the axis of the rotor assembly. The rotor assembly is adapted to receive at least one lamp pin within the channel from an edge of the rotor assembly. Each of the at least one lamp pin defines a longitudinal axis and each of the axis of each of the at least lamp pin is about parallel to the axis when each of the at least one lamp pin is received from the edge of the rotor assembly to within the channel. The housing is adapted to receive the rotor assembly such that one of the housing and/or the rotor assembly is rotatable about the axis about perpendicular to the surface of the rotor assembly. The housing defines a notch adapted to receive each of the at least one lamp pin when each of the axis of each of the at least one pin is about parallel to the axis. One of the housing and the rotator assembly is rotatable to at least first and second positions and the channel of the rotor assembly aligns with the notch of the housing when in the first position such that each of the at least one lamp pin is received through the notch of the housing and into the channel of the rotor assembly. The at least one electrical contact is disposed within the housing. An electrical contact of the at least one electrical contact is adapted for operative engagement with a lamp pin of the at least one lamp pin. The electrical contact is operatively disengaged from the lamp pin when the one of the housing and the rotor assembly is in about the first position and operatively engages the lamp pin when the one of the housing and the rotor assembly is rotated at least substantially to the second position.

In yet another embodiment of the present disclosure, a method of using a lamp includes: providing the lamp having a lamp pin disposed thereon; providing a lamp socket; inserting the lamp pin into the channel such that the lamp pin is received from the edge of the rotor assembly to within the channel; and rotating the rotor assembly to the second positions such that the electrical contact operatively engages the lamp pin.

BRIEF DESCRIPTION OF THE DRAWINGS

These and other advantages will become more apparent from the following detailed description of the various embodiments of the present disclosure with reference to the drawings wherein.

DETAILED DESCRIPTION

Figure 1:
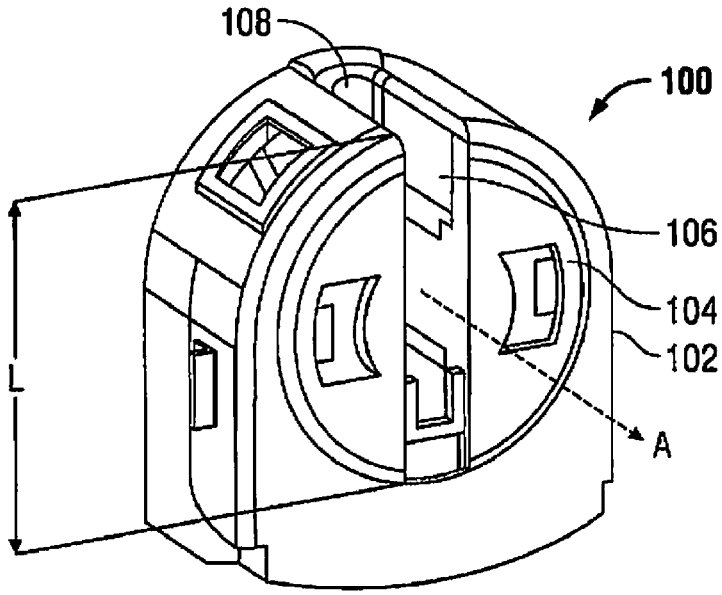
FIG. 1 shows a multi-pin socket assembly having a housing adapted to be detachably attachable to a mounting structure in accordance with the present disclosure.

Referring to the drawings, FIG. 1 shows a multi-pin socket assembly 100 having a housing 102 adapted to be detachably attachable to a mounting structure (not shown in FIG. 1) in accordance with the present disclosure. Although the embodiment shown in FIG. 1 is shown as being adapted to receive two lamp pins, embodiments of one or more lamp pins are envisioned. Multi-pin socket assembly 100 includes a housing 102. Multi-pin socket assembly 100 also includes a rotor assembly 104 that can rotate within housing 102. Rotor assembly 104 can rotate within housing 102 about Axis "A". Rotor assembly 104 defines a channel 106 having a length "L". Additionally, housing 102 defines a notch 108. Although rotor assembly 104 is rotatable within housing 102, it is envisioned that housing 102 is rotatable in other embodiments such that an electrical connection is made to the lamp pins via electrical contacts by rotating housing 102 (not shown).

Rotor assembly 104 can receive two-lamp pins (not shown) within channel 106 via notch 108. The lamps pins can cause rotor assembly 104 to rotate. The lamps pins cause rotation when the lamp is rotated. The lamp pins are received when about parallel to axis "A". Once the lamp pins are within channel 106, rotor assembly 104 may be rotated around axis "A" thereby also rotating the lamp pins along with the attached lamp (not shown).

Initially, when the rotor assembly 104 is in the position as shown in FIG. 1, the channel 106 is aligned with notch 108 to receive the lamp pins. After the two-lamp pins are received, electrical contacts therein (not visible in FIG. 1) are not in electrical communication with the lamp pins. However, rotor assembly 104 is rotatable from the position shown in FIG. 1 to other positions, e.g., 90 degree of rotation from the position as shown in FIG. 1.

When the rotor assembly 104 is rotated 90 degrees about axis "A", the lamp pins positioned therein make electrical contact with the pins when about fully rotated. This prevents the lamp from being energized because the two lamp pins are not in electrical communication until rotor assembly 104 is rotated to a second predetermined position, which in this embodiment as mentioned above, is 90 degrees of rotation around axis "A".

Additionally, the electrical contacts may protrude (not shown) into the channel 106, thus "snapping" rotor assembly 104 into a semi-locked position while simultaneously and suddenly making full electrical contact with the lamp-pins with the electrical contacts disposed therein (discussed in more detail below). The electrical contacts within multi-pin socket assembly are adapted for being electrically wired for sufficient operation of the lamp, e.g., a fluorescent lamp may be wired to an electrical ballast via the internal electrical contacts. Additionally, multi-pin socket assembly 100 may have torque resistance from further rotation about axis "A" after positioned in the semi-locked position.

Multi-pin socket assembly 100 may be adapted to receive several types of lamp sockets, including a T5 lamp, a T8 lamp and a T12 lamp. The lamps pins may be positioned at or near the periphery of rotor assembly 104 when positioned therein. Multi-pin socket assembly 100 may also be adapted to be attachable to a mounting structure (not shown in FIG. 1). For example, multi-pin socket assembly 100 may be detachably attachable to a mounting structure such that axis "A" is parallel to a panel (as mounted thereto) and is a distance therefrom, e.g., 16 millimeters, 20 millimeters or 23 millimeters. The distance may be any amount, for example the first distance may be greater than 12 millimeters, e.g., from about 16 millimeters to about 30 millimeters.

Figure 2A:
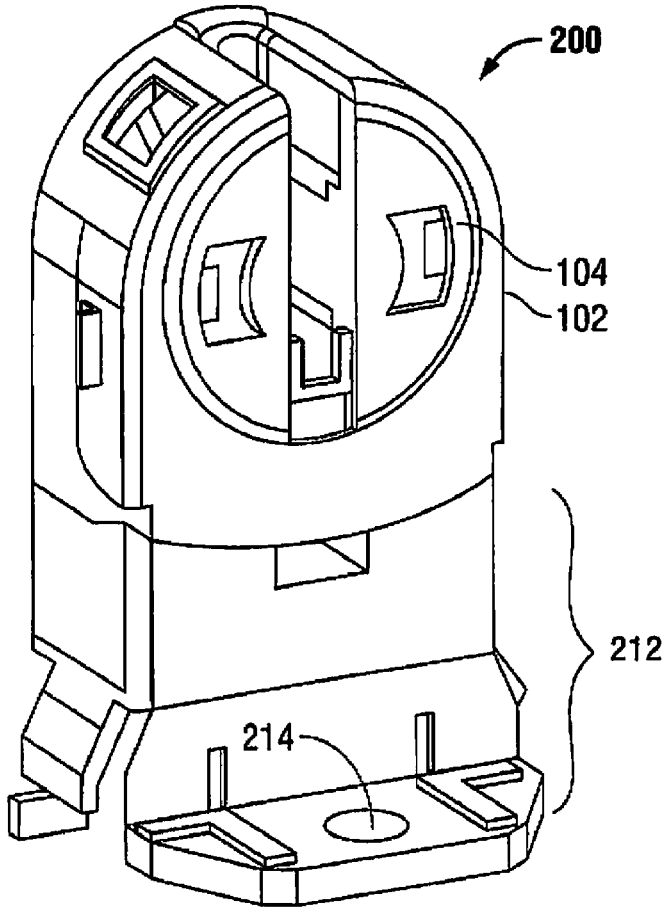
FIGS. 2A-2F show the multi-pin socket assembly of FIG. 1 further including a variety of mounting structures in accordance with the present disclosure.
Figure 2B:
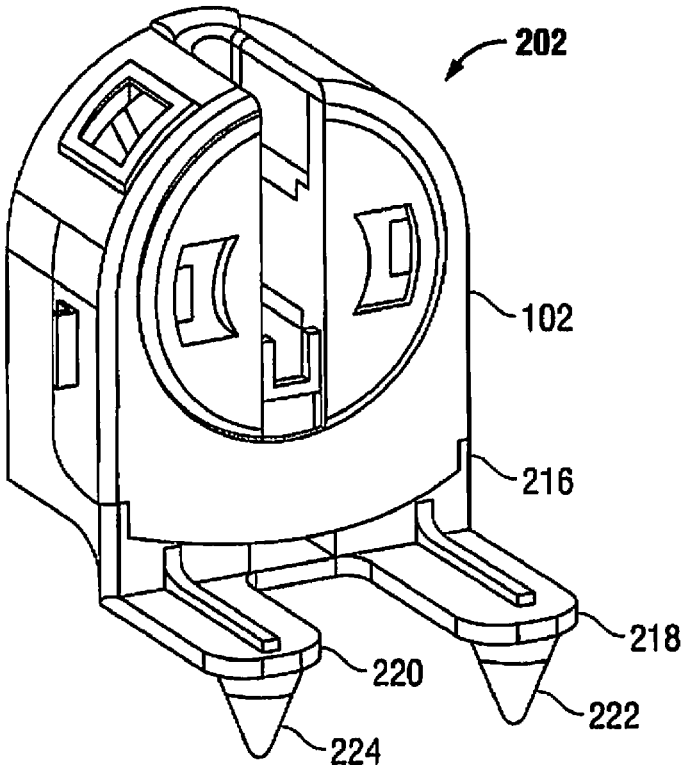
Figure 2C:
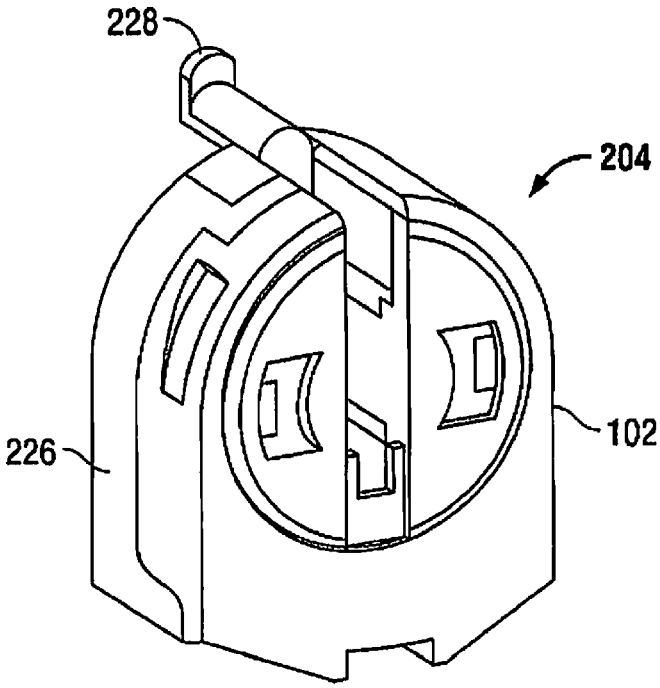
Figure 2D:
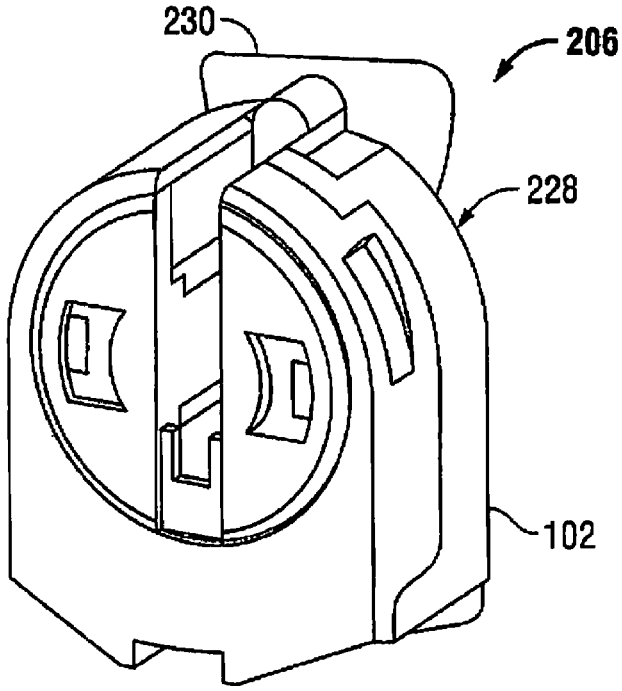
Figure 2E:
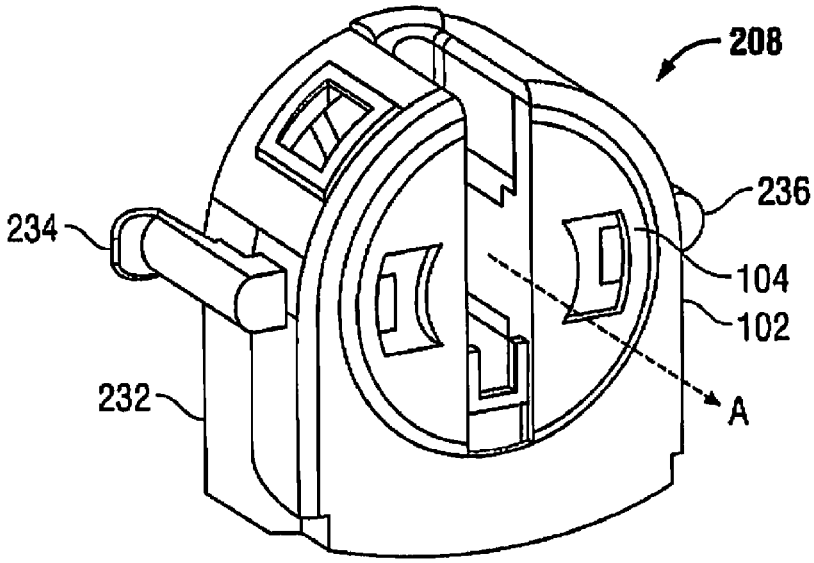
Figure 2F:
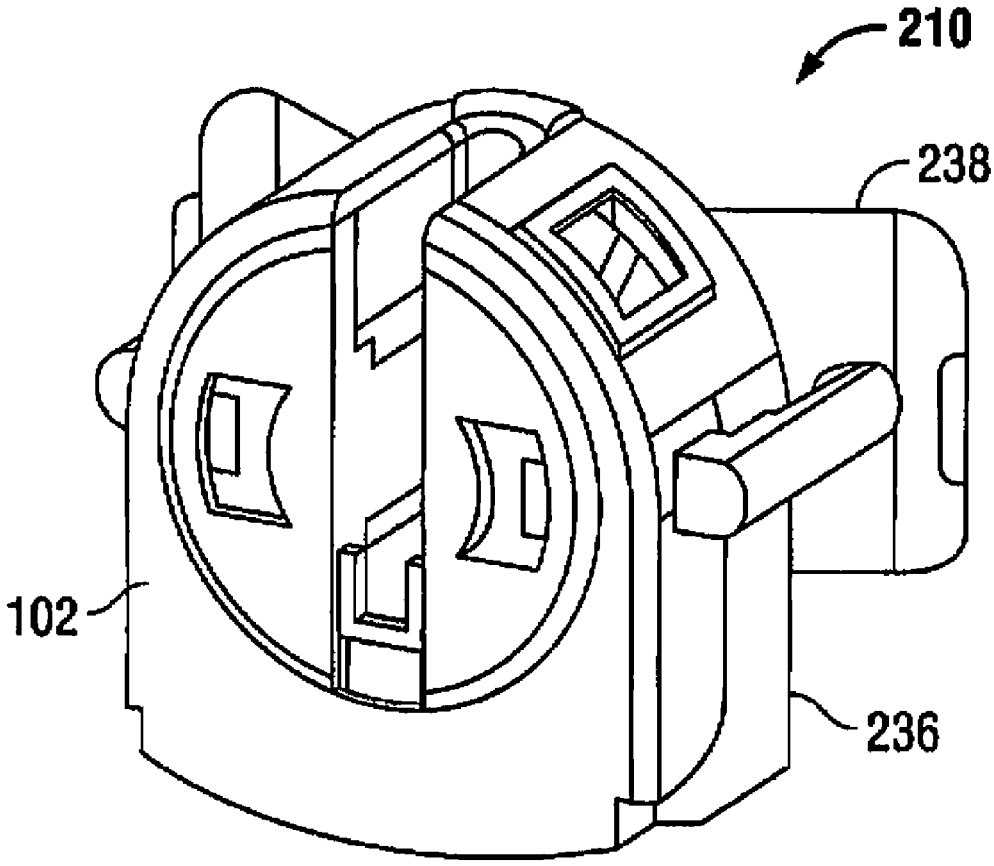

Referring to the drawings, FIGS. 2A-2F show the multi-pin socket assembly 102 of FIG. 1 further including a variety of mounting structures in accordance with the present disclosure. FIG. 2A shows multi-pin socket assembly 200; FIG. 2B shows multi-pin socket assembly 202; FIG. 2C shows multi-pin socket assembly 204; FIG. 2D shows multi-pin socket assembly 206; FIG. 2E shows multi-pin socket assembly 208; and FIG. 2F shows multi-pin socket assembly 210.

FIG. 2A shows a multi-pin socket assembly 200 including housing 102 and mounting structure 212. Mounting structure 212 attaches housing 102 with rotor assembly 104 to a panel (not shown). For example, two of multi-pin assemblies 200, each facing each other may be attached to a lighting panel. A fluorescent bulb (not shown) may be positioned between the two multi-pin socket assemblies 200 and thereafter may be rotated to enable electrical communication with the fluorescent bulb. Multi-pin socket assembly 200 is attachable to a panel via hole 214. A fastener, e.g., a screw, fastens multi-pin socket assembly 200 to a panel through hole 214.

FIG. 2B shows a multi-pin socket assembly 202 including a mounting structure 216. Mounting structure 216 includes legs 218 and 220. Leg 218 includes a snap 222 and leg 220 include a snap 224. Snaps 222 and 224 can snap into a panel having sufficiently sized holes (not shown). Each of snaps 222 and 224 snap into a respective hole of the holes.

FIG. 2C shows a multi-pin socket assembly 204 including a mounting structure 226. Mounting structure 226 includes snap 228 adapted to snap into a panel. FIG. 2D shows a multi-pin socket assembly 206 having a mounting structure 228, similar to mounting structure 226 of FIG. 2C, however, mounting structure 228 includes a spring 230. Spring 230 may be a planar piece of metal having a bend inwards towards mounting structure 228. When mounting structure 228 is mounted to a panel, spring 230 presses against the panel because of the bend thereby applying resistance force against multi-pin socket assembly 206 being pressed into a panel.

FIG. 2E shows a multi-pin socket assembly 208 having a mounting structure 232. Mounting structure 232 is attachable to a panel such that axis "A" of rotor assembly 104 is perpendicular to the panel (not shown). Mounting structure 232 includes a snap 234 and a snap 236. Snap 236 is partially obscured by mounting structure 232, however, it is a "mirror" image of snap 234. Snaps 234 and 236 may be placed into two holes of a panel (not shown) to secure multi-pin socket assembly 208 thereto.

FIG. 2F shows a multi-pin socket assembly similar to multi-pin socket assembly 208; however, multi-pin socket assembly 210 includes a mounting structure 236 with a spring 238. Spring 238 may be a planar and flexible piece of metal with a preformed bend, such that spring 238 resists being pressed between mounting structure 232 and a panel.

Figure 3:
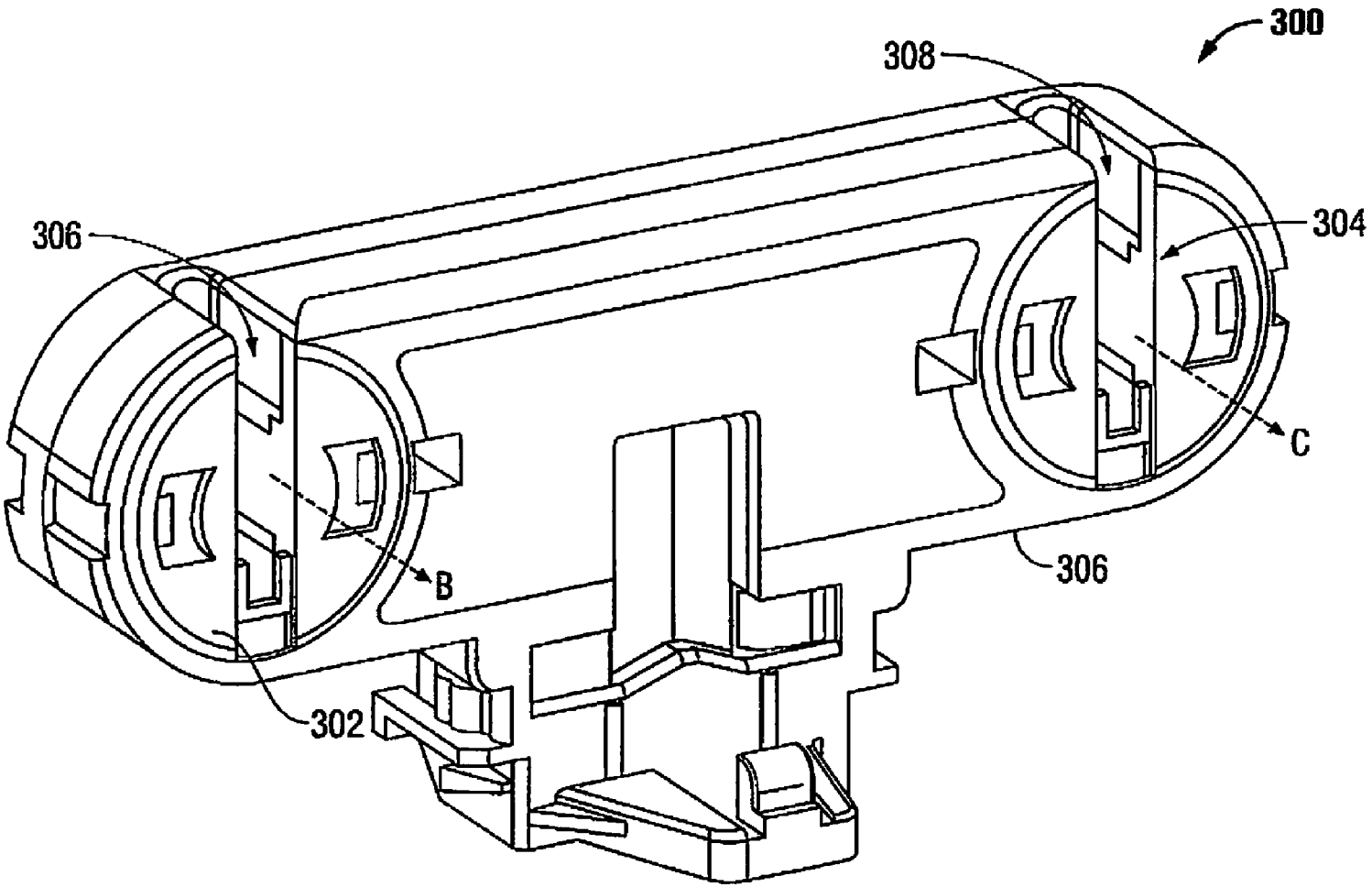
FIG. 3 shows a multi-pin socket assembly having two rotor assemblies with a common mounting structure adapted to mount to a panel in accordance with the present disclosure.

FIG. 3 shows a multi-pin socket assembly 300 having two rotor assemblies 302 and 304 with a common mounting structure 306 adapted to mount to a panel (not shown) in accordance with the present disclosure. Rotor assemblies 302 and 304 are rotatable about axes "B" and "C", respectively.

Rotor assemblies 302 and 304 are each adapted to receive lamp pins (not shown) via channels 306 and 306, respectively. After the pins are received, each may be rotated about 90-degree which causes rotor assemblies 302 and 304 to make electrical contact to the lamp pins and semi-lock rotor assemblies 302 and 304 into the 90-degree position. Electrical contacts disposed within multi-pin socket assembly may protrude through channels 306 and 308 (discussed below). Mounting structure 306 mounts rotor assemblies 302 and 306 to a panel (not shown).

Figure 4:
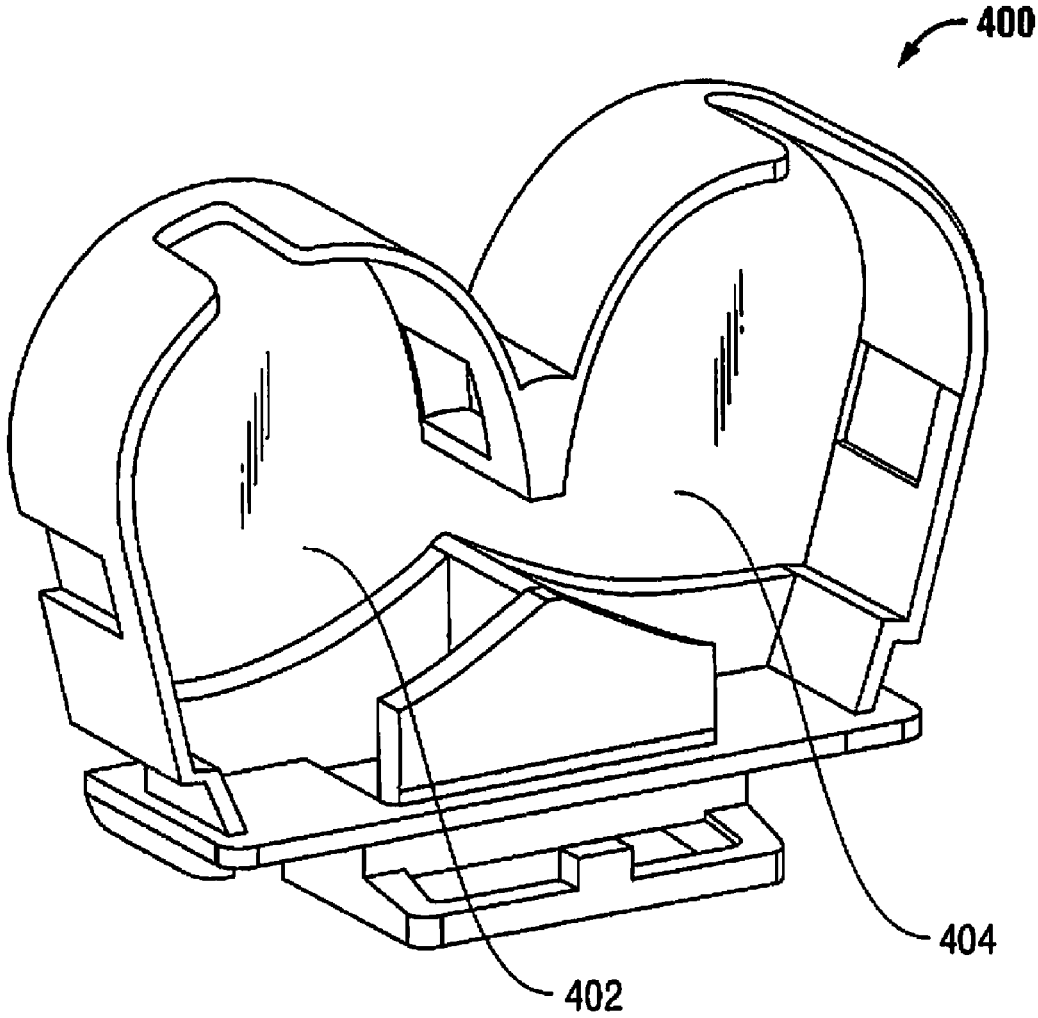
FIG. 4 shows a mounting structure shaped and adapted to receive two of the multi-pin sockets of the one shown in FIG. 1 in accordance with the present disclosure.

Referring to the drawings, FIG. 4 shows a mounting structure 400 shaped and adapted to receive two of the multi-pin sockets 100 as shown in FIG. 1 in accordance with the present disclosure. Mounting structure 400 includes cavities 402 and 404. Each of cavities 402 and 404 can receive a rotor assembly, e.g., rotor assembly 104 of FIG. 1. Additionally or alternatively, each of cavities 402 and 404 can receive a housing of a rotor assembly, e.g., housing 102 of FIG. 1, which may also include rotor assembly 104 positioned therein.

Figure 5:
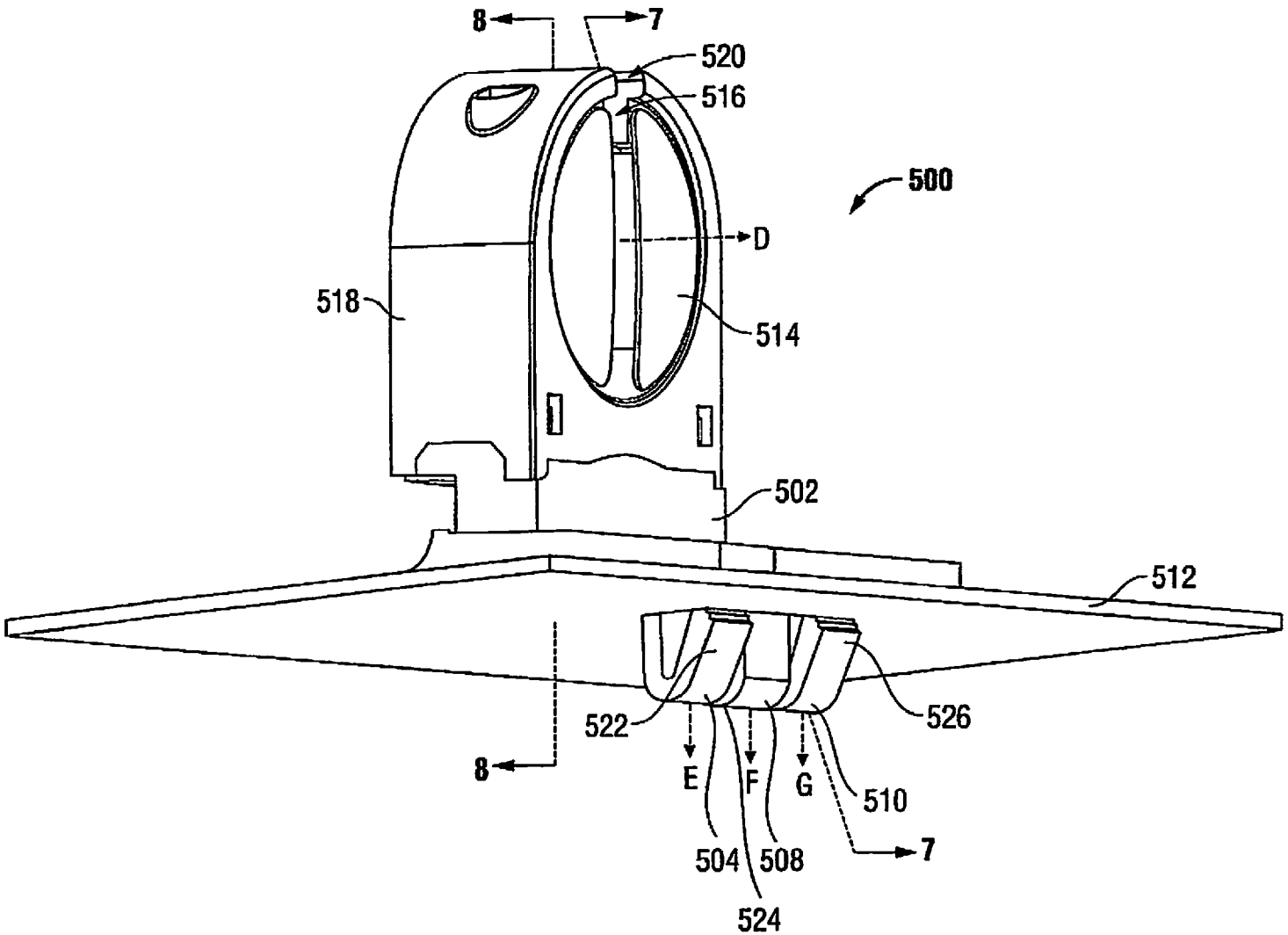
FIG. 5 shows a multi-pin socket assembly having a mounting structure with three snaps for mounting the mounting structure through a hole in accordance with the present disclosure.

Referring to the drawings, FIG. 5 shows a multi-pin socket assembly 500 having a mounting structure 502 with snaps 504, 508 and 510. Snaps 504, 508, and 510 are shown as being mounted to panel 512. Multi-pin socket assembly 500 includes a rotor assembly 514 having a channel 516. Multi-pin socket assembly 500 also includes a housing 518.

Rotor assembly 514 is disposed within housing 518 and is rotatable therewithin. Housing 518 defines a notch 520. Although notch 520 is shown as being about the same width as channel 516, notch 520 may be larger or smaller than the width of channel 516. Additionally or alternatively, notch 520 may be substantially surrounding rotor assembly 514, e.g., housing 518 may not extend flush with rotor assembly 514 thereby the "notch", in this example, would extend all around rotor assembly 514 (not shown).

Multi-pin socket assembly 500 also includes securing members, i.e., snaps 504, 508, and 510. Snaps 504, 508, and 510 each include flanges 522, 524, and 526, respectively. Flange 522 defines an axis "E", flange 524 defines an axis "F" and flange 526 defines an axis "G". Note that flange 524 has a radial angle (along axis "F") of about 180 degrees relative to the radial angles of flanges 522 and 526 (along axes "E" and "G", respectively). The radial angle is defined by the angle in which the flange generally points. For example, snap 504 has a flange 522 that has a radial angle that is about parallel to axis "D", i.e., note that flange 522 is pointing towards a direction about parallel to the direction axis "D" points towards.

Figure 6:
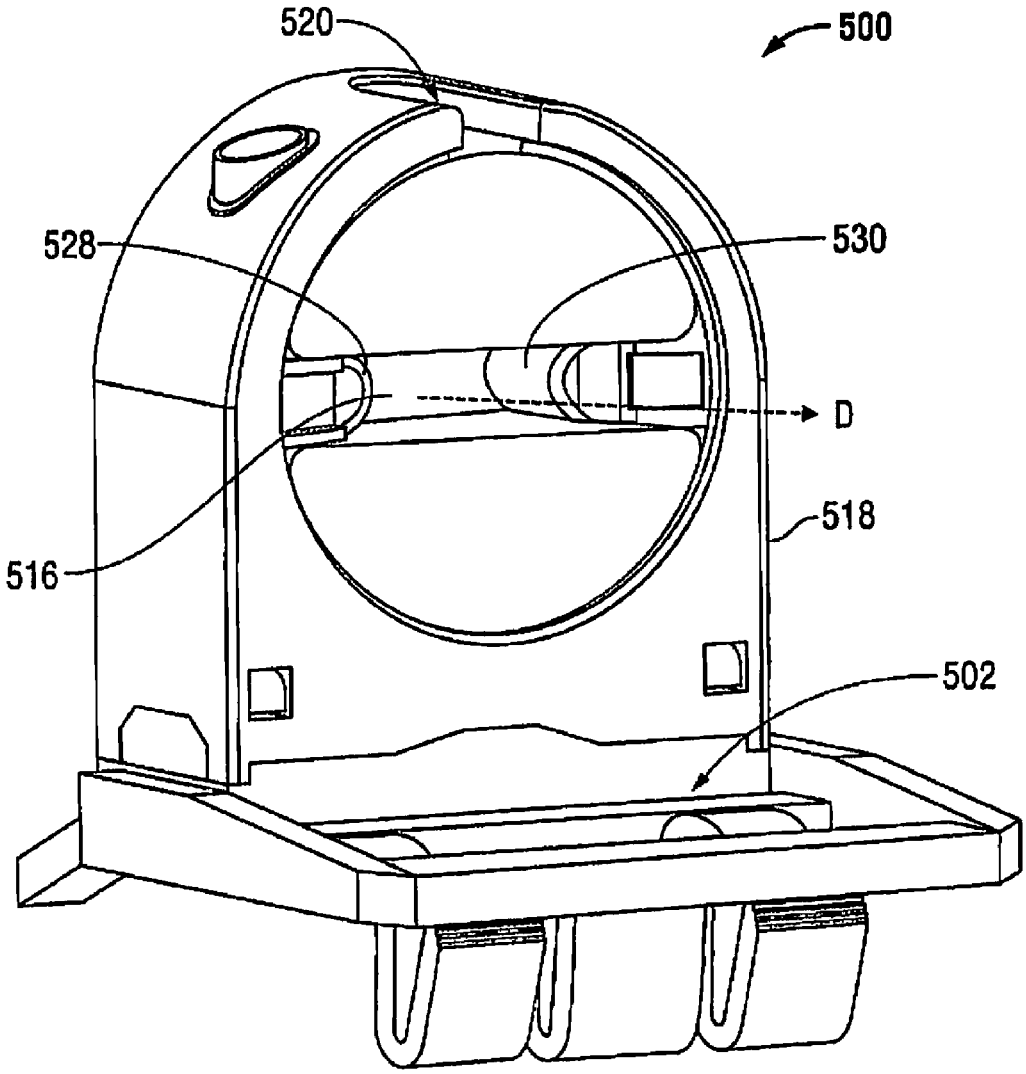
FIG. 6 shows the multi-pin socket assembly of FIG. 5 with the rotor assembly rotated to a second position such that lamp pins make contact with electrical contacts disposed therein in accordance with the present disclosure.

Note that rotor assembly 514 is positioned within housing 518 and that the channel 516 is orientated in a first position therewithin. Refer now simultaneously to FIGS. 5 and 6. FIG. 6 also shows the multi-pin socket assembly 500 of FIG. 5. Note that the rotor assembly 514 is rotated to a second position, which is about 90-degrees of rotation along axis "D" relative to the first position as shown in FIG. 5. Multi-pin socket assembly 500 also includes electrical contacts 528 and 530. Electrical contacts 528 and 530 extend into channel 516 to make electric contact with lamp pins (not shown) positioned within channel 516. Electrical contacts 528 and 530 extent into channel 516 which resists further rotation along axis "D".

Additionally, electrical contacts 528 and 530 may be configured to quickly and suddenly enter into channel 516 to semi-secure (i.e., resist further rotation about axis "D") rotor assembly 514; this also facilitates direct and complete electrical contact with pins positioned within channel 516. The details of electrical contacts 528 and 530 are discussed below.

Figure 7:
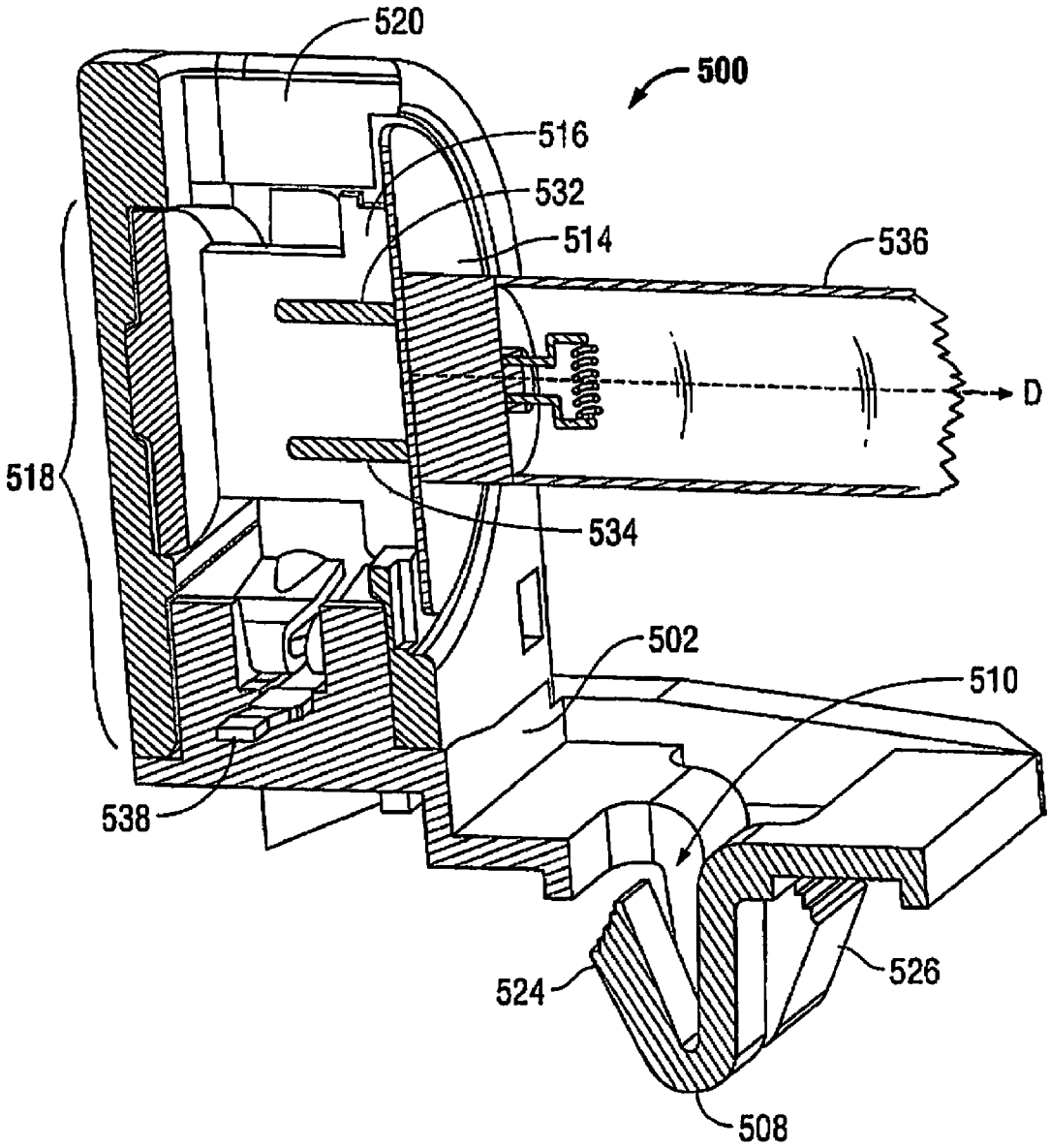
FIG. 7 shows a cross-sectional view of the multi-pin socket assembly of FIG. 5 which also shows a cross-sectional view of the rotor assembly in accordance with the present disclosure.

Referring again to FIG. 5, note the cross-sectional portion of multi-pin socket assembly 500 as indicated along lines 7-7. Referring to the drawings, FIG. 7 is the cross-sectional view of multi-pin socket assembly 500 along line 7-7 of FIG. 5. FIG. 7 also shows a cross-sectional view of rotor assembly 514. FIG. 7 shows lamp pins 532 and 534 as positioned within channel 516 of rotor assembly 514.

Rotor assembly 514 has a general circular shape to facilitate rotation along axis "D". Pins 532 and 534 are of lamp 536. After pins 532 and 534 of lamp 536 are inserted into channel 516 via notch 520, lamp 536 may be rotated along axis "D" thereby rotating rotor assembly 514 therewith. Thereafter, electrical contacts 528 and 530 will contact pins 532 and 534, respectively, providing an electrical connection for proper operation of lamp 536. Also, multi-pin socket assembly 500 includes shunt 538 for electrically connecting together electrical contacts 528 and 530, thus keeping pins 532 and 534 in electrical communication.

Most fluorescent lamps (e.g., lamp 536) have four pins with two at each end. Each pair of pins at each end has an opposite charge relative to the other pair. Older ballast systems utilize pins 532 and 534 by communicating electrically to them separately, however, most modern electrical ballasts utilize them such that they are electrically connected.

Figure 8:
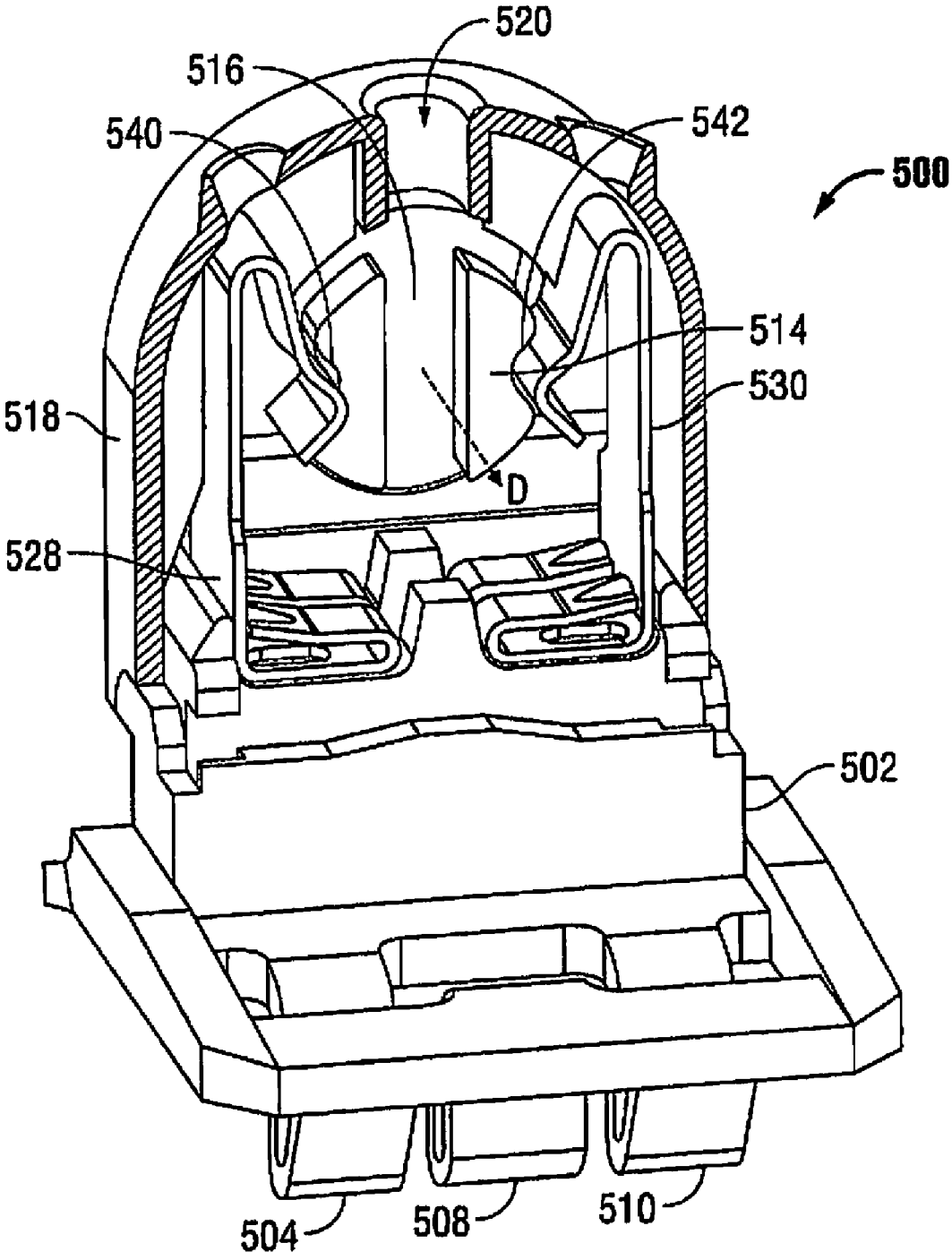
FIG. 8 shows another cross-sectional view of the multi-pin socket assembly of FIG. 5 in accordance with the present disclosure

Referring to FIGS. 5 and 8, multi-pin socket assembly 500 is shown in FIG. 8 as the cross sectional view along lines 8-8 of FIG. 5. Rotor assembly 514 is shown and is disposed within housing 518. Rotor assembly 514 is rotatable within housing 518 along axis "D". Disposed within housing 518 are electrical contacts 528 and 530. Note that electrical contacts 528 and 530 semi-secure rotor assembly 514 via dimples 540 and 542. Dimples 540 and 542 each provided resistance torque when rotor assembly 514 is positioned such that channel 516 is aligned with notch 520.

Additionally, when rotor assembly 524 is rotated along axis "D" about 90-degree to a second position, each of electrical contacts 528 and 530 extend into channel 516 thus providing torque resistance away from the second position, and securing lamp pins disposed therein to electrical contacts 528 and 530.

Figure 9:
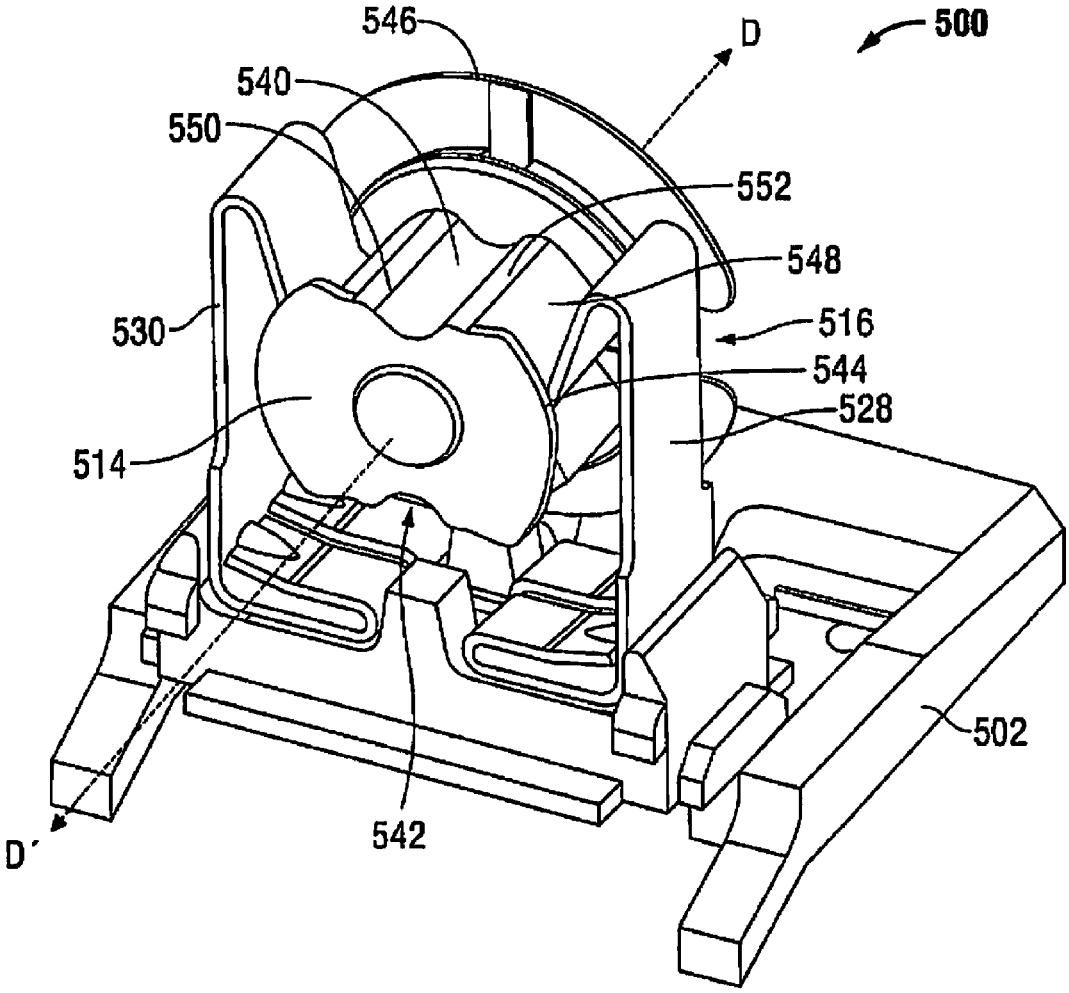
FIG. 9 shows the multi-pin socket assembly of FIG. 5 with the rotor assembly rotated to a second position such that lamp pins make contact with electrical contacts disposed therein without the housing being shown in accordance with the present disclosure.

Referring to the drawings, FIG. 9 shows the multi-pin socket assembly 500 of FIG. 5 with the rotor assembly 514 rotated to a second position such that lamp pins (not shown) make contact with electrical contacts 528 and 530 in accordance with the present disclosure. Multi-pin socket assembly 500 is shown without the housing 518 (see FIG. 5). Multi-pin socket assembly 500 is shown such that rotor assembly 514 is easily seen. Rotor assembly 514 includes dimples 540 and 542 to provide a semi-locking mechanism (resists rotational movement with counter-torque) because electrical contacts 528 and 530 "press" into dimples 540 and 542 when rotor assembly 514 is rotated about axis "D". Note that rotor assembly 514 includes an engagement surface 548 defined around axis "D". Dimple 540 is defines as a recessed portion being closer to axis "D" than adjacent portions 550 and 522. As previously mentioned, dimple 540 is shaped to receive electrical contacts 528 and 530. The negative direction of axis "D" is indicated by an arrow labeled as D'. As shown, both of electrical contacts 528 and 530 protrude into channel 516 from opposite positions. Also note that rotor assembly 514 includes lips 544 and 546 which guide electrical contacts 528 and 530 to remain in a sufficient position around rotor assembly 514 throughout rotation of rotor assembly 514 about axis "D".

Figure 10:
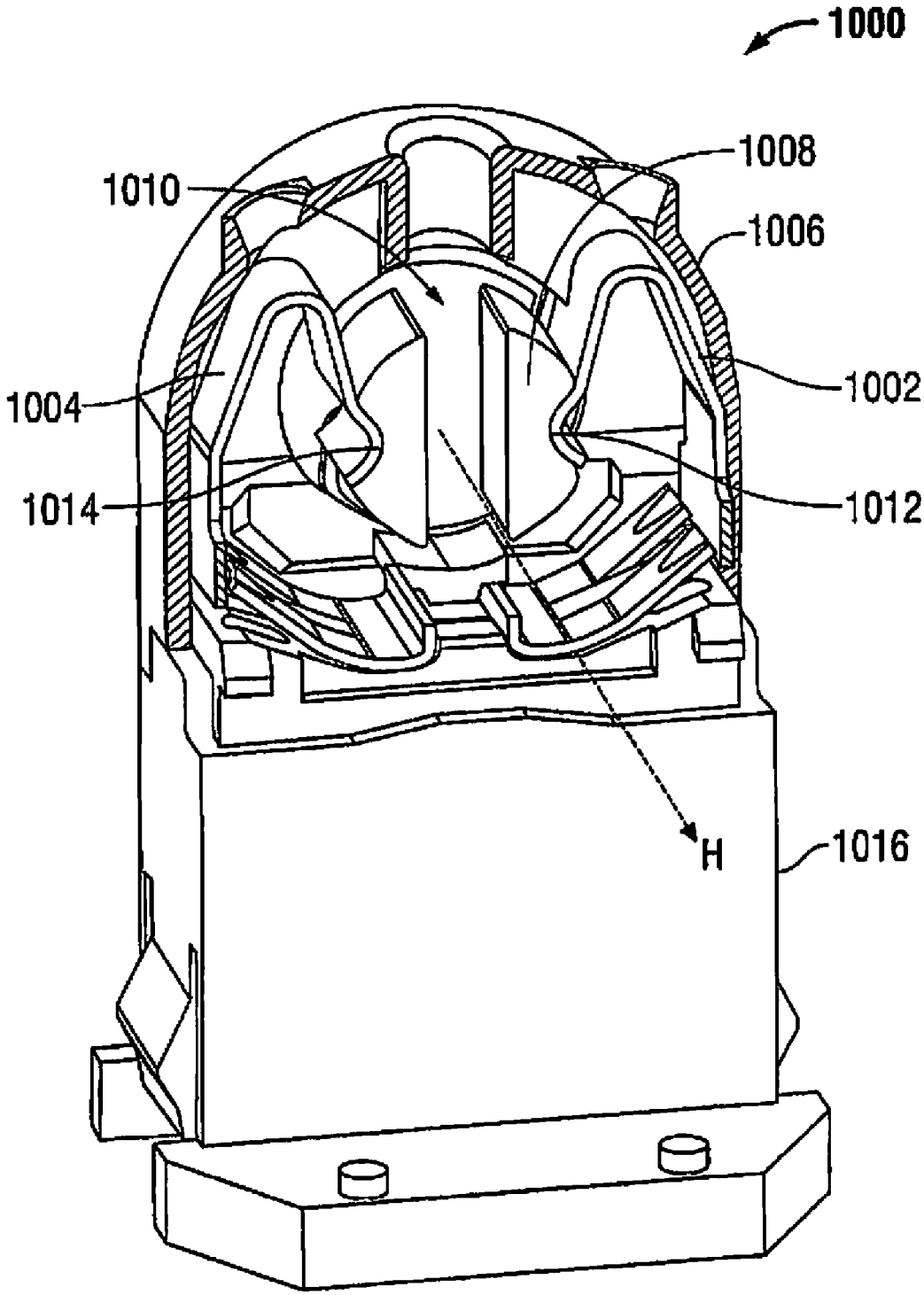
FIG. 10 shows a cross-section view of another multi-pin socket assembly having another embodiment of electrical contacts disposed therein in accordance with the present disclosure.

FIG. 10 shows a cross-section view of a multi-pin socket assembly 1000 having electrical contacts 1002 and 1004 disposed therein in accordance with the present disclosure. Electrical contacts 1002 and 1004 are disposed within housing 1006. Additionally, rotor assembly 1008 is shown and rotates about an axis "H". Rotor assembly 1008 has a channel 1010 such that electrical contacts 1002 and 1004 can protrude therein to make electrical contact with lamp pins (not shown). Multi-pin socket assembly 1000 also includes a housing 1016 for mounting to a structure. Note that electrical contacts 1002 and 1004 have a different shape than the embodiment as shown in FIG. 8 (see electrical contacts 528 and 530).

Figure 11:
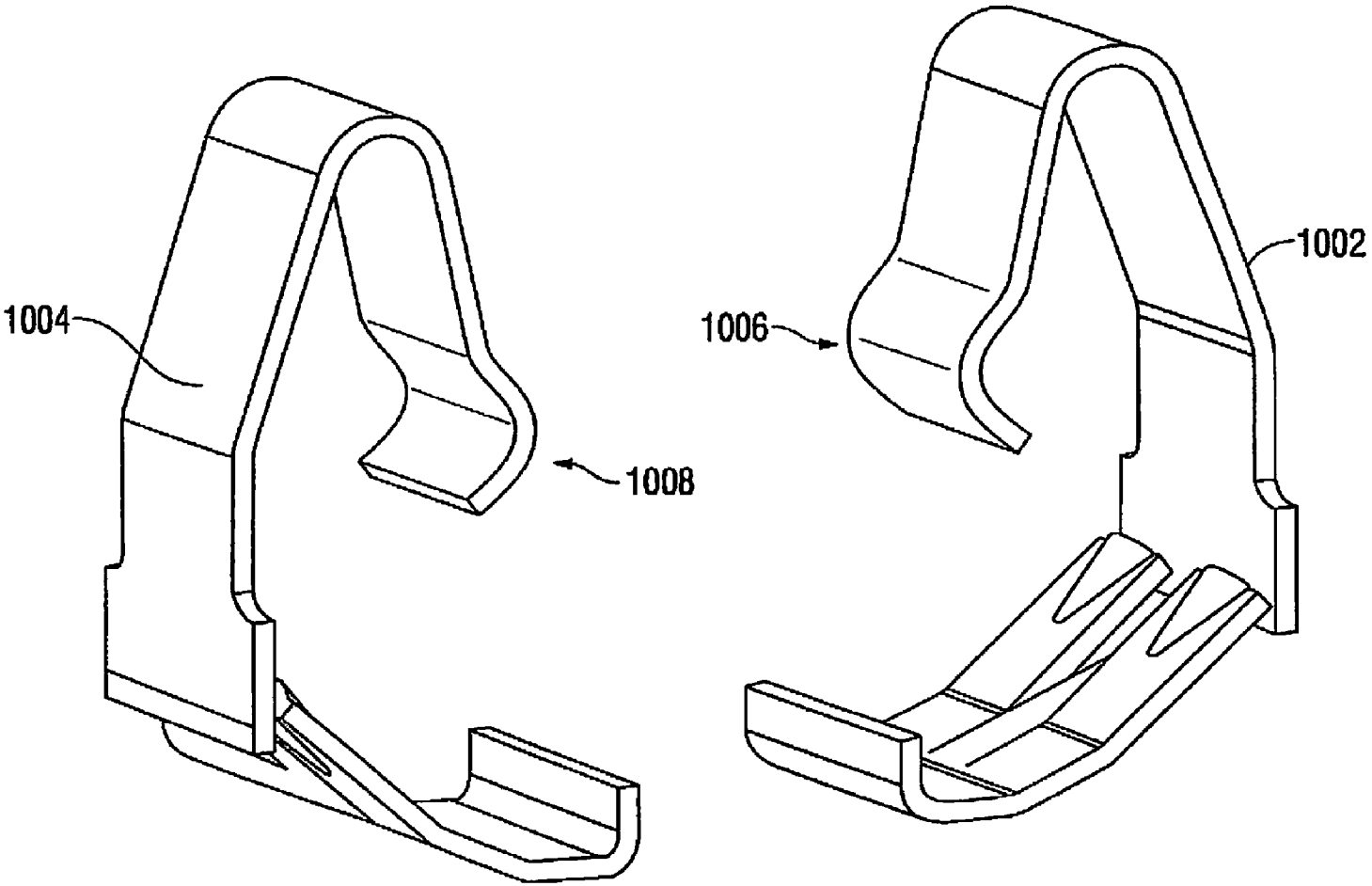
FIG. 11 shows the electric contacts of the multi-pin socket assembly of FIG. 10 in accordance with the present disclosure.

Refer now to FIG. 11 which shows electric contacts 1002 and 1004 of the multi-pin socket assembly 1000 of FIG. 10 in accordance with the present disclosure. Electrical contacts 1002 and 1004, include protrusion members 1006 and 1008, respectively, to protrude into channel 1010 of rotor assembly 1008 (see FIG. 10). Additionally, protrusion members 1006 and 1008 are adapted to protrude into dimples 10102 and 1014 of rotor assembly 1008 (see FIG. 10).

While several embodiments of the disclosure have been shown in the drawings and/or discussed herein, it is not intended that the disclosure be limited thereto, as it is intended that the disclosure be as broad in scope as the art will allow and that the specification be read likewise. Therefore, the above description should not be construed as limiting, but merely as exemplifications of particular embodiments.

What is claimed is:

1. A mounting structure for coupling a lampsocket for a fluorescent lamp to a fixture panel, the mounting structure comprising:

at least three snaps extending from a bottom surface of the mounting structure, each of the at least three snaps includes an elongated length having a longitudinal axis and a flange disposed at an end thereof, each flange having a longitudinal axis, wherein the longitudinal axis of each flange of each of the at least three snaps extends at an angle with respect to the longitudinal axis of the elongated length of its respective snap, wherein all of the at least three snaps are adapted for insertion into a single opening formed in a panel, and wherein one of the plurality of flanges extends towards a rear surface of the mounting structure as compared to at least one other flange of the at least three snaps which extends towards a front surface of the mounting structure.

2. The mounting structure according to claim 1, wherein a flange of one of the at least three snaps extends at a different angle than a flange of another one of the at least three snaps.

3. The mounting structure according to claim 1, wherein at least two flanges of at least two snaps of the at least three snaps extend at different angles.

4. The mounting structure according to claim 1, further comprising:

a base coupled to the at least three snaps such that the at least three snaps extend from a bottom surface of the base; and a housing of a lampholder.

5. The mounting structure according to claim 4, wherein the housing includes a rotor adapted to receive at least one of a T5 lamp, a T8 lamp and a T12 lamp.

6. The mounting structure according to claim 1, further comprising:

a housing having a rotor, wherein the mounting structure is adapted to mount the housing to a panel such that an axis of rotation of the rotor is about parallel to the panel and is about a first distance therefrom.

7. A mounting structure for coupling a lampsocket to a fixture panel, the mounting structure comprising:

a base;

a first snap extending from a first surface of the base and including a first elongated length having a first longitudinal axis;

a second snap extending from the first surface of the base and including a second elongated length having a second longitudinal axis; and a third snap extending from the first surface of the base and including a third elongated length having a third longitudinal axis, wherein the first, second and third snaps are adapted for insertion into a single hole formed in a panel, and wherein a flange of at least one of the first, second and third snaps extends towards a rear surface of the mounting structure as compared to another flange of at least one other of the first, second and third snaps which extends towards a front surface of the mounting structure.

8. The mounting structure according to claim 7, wherein the second snap is disposed between the first and third snaps.

9. The mounting structure according to claim 7, further comprising a spring coupled to the base and adapted to compress against a panel.

10. The mounting structure according to claim 9, wherein the spring compresses against a panel when the first, second, and third snaps are secured within a hole of the panel.

11. The mounting structure according to claim 7, wherein the first, second, and third snaps are integrated together with the base.

12. The mounting structure according to claim 7, wherein the base includes a support member, and the first elongated length is coupled to the support member by a bend.

13. The mounting structure according to claim 7, wherein the first, second and third snaps each include a projection, the first, second and third projections including a first, second and third longitudinal axis, respectively, the first, second and third longitudinal axis of the projections defining an angle of rotation with respect to the first, second and third longitudinal axis of the first, second and third snaps, respectively.

14. The mounting structure according to claim 13, wherein the projection is a flange.

15. The mounting structure according to claim 14, wherein the flange projects towards the mounting structure thereby forming a generally V-shaped or U-shaped snap.

16. The mounting structure according to claim 13, wherein the projection extends from a bend of the first, second and third elongated lengths, respectively.

17. The mounting structure according to claim 13, wherein an end of the projection includes a plurality of ridges perpendicular to another axis parallel to the first longitudinal axis.

18. The mounting structure according to claim 7, wherein the base includes first and second support members, wherein the first and third snaps are coupled to the first support member, and the second snap is coupled to the second support member.

19. The mounting structure according to claim 18, wherein the base includes first and second side-support members, wherein the first and second support members are coupled to the first side-support member on a right side of the mounting structure, and the first and second support members are coupled to the second side-support member on a left side of the mounting structure.

20. The mounting structure according to claim 19, wherein the first and second side-support members are parallel to each other.

21. The mounting structure according to claim 19, wherein the first side-support member includes a spring adapted to apply a force against a panel when the first, second, and third snaps are secured through a hole of the panel.

22. The mounting structure according to claim 21, wherein the spring is another elongated length having a bend when uncompressed.

23. A socket assembly, comprising:

a mounting structure having first, second, and third snaps extending therefrom, the snaps being adapted to secure the mounting structure to a panel, each of the first, second, and third snaps includes an elongated length having a longitudinal axis and a flange disposed at an end thereof, each flange having a longitudinal axis, wherein the longitudinal axis of each flange of each of the first, second, and third snaps extends at an angle with respect to the longitudinal axis of the elongated length of its respective snap, and wherein one of the flanges extends towards a rear surface of the mounting structure as compared to at least one other flange which extends towards a front surface of the mounting structure; and a lamp socket adapted to receive a lamp, the lamp socket operatively connected to the mounting structure to operatively secure the lamp to the panel, wherein all of the first, second, and third snaps are adapted for insertion into a single opening formed in the panel.

24. The socket assembly of claim 23, wherein the lamp socket further comprises:

a rotor assembly having an axis of rotation and defining a channel having a length about perpendicular to the axis of rotation, the rotor assembly adapted to receive at least one lamp pin within the channel from an edge of the rotor assembly, each of the at least one lamp pin having a longitudinal axis, each of the axis of each of the at least lamp pin being about parallel to the axis of rotation when each of the at least one lamp pin is received from the edge of the rotor assembly to within the channel;

a housing adapted to receive the rotor assembly such that the rotor assembly is rotatable along its axis of rotation therein, wherein the housing defines a notch adapted to receive each of the at least one lamp pin when each of the axis of each of the at least one pin is about parallel to the axis of rotation, wherein the rotator assembly is rotatable to at least first and second positions and the channel of the rotor assembly aligns with the notch of the housing when in the first position such that each of the at least one lamp pin is received through the notch of the housing and into the channel of the rotor assembly; and at least one electrical contact disposed within the housing, an electrical contact of the at least one electrical contact adapted for operative engagement with a lamp pin of the at least one lamp pin, wherein the electrical contact is operatively disengaged from the lamp pin when the rotor assembly is in about the first position and operatively engages the lamp pin when the rotor assembly is rotated at least substantially to the second position.

* * * * *